US006547109B1

(12) United States Patent
Kim

(10) Patent No.: US 6,547,109 B1
(45) Date of Patent: Apr. 15, 2003

(54) PIN PICKUP AND ARTICLE HOLDER APPARATUS

(76) Inventor: Susan Young Sook Kim, 23120 W. Lyons Ave., No. 22, Newhall, CA (US) 91321

( * ) Notice: Subject to any disclaimer, the term of this patent is extended or adjusted under 35 U.S.C. 154(b) by 0 days.

(21) Appl. No.: 09/996,322

(22) Filed: Nov. 21, 2001

(51) Int. Cl.[7] ..... A41H 31/00
(52) U.S. Cl. ..... 223/109 R
(58) Field of Search ..... 223/109 R

(56) References Cited

U.S. PATENT DOCUMENTS

| | | | |
|---|---|---|---|
| D31,302 | S | 8/1899 | Sinclair et al. |
| 633,181 | A | 9/1899 | Bernard |
| 667,673 | A | 2/1901 | Burkart |
| D39,514 | S | 9/1908 | Buehler |
| 1,696,771 | A | 12/1928 | Larson |
| 2,002,766 | A | 5/1935 | Carlston |
| 2,452,400 | A | 10/1948 | Stevens |
| 2,455,506 | A | 12/1948 | Leslie |
| 5,507,041 | A | 4/1996 | Wright |

*Primary Examiner*—John J. Calvert
*Assistant Examiner*—James G Smith
(74) *Attorney, Agent, or Firm*—Thomas I. Rozsa; Tony D. Chen

(57) ABSTRACT

A pin pickup and article holder apparatus can be removably attachable to any metal surface of a sewing machine for retaining loose pins as well as loose sewing articles, such as chalk, spools of thread, buttons, beads, etc. The apparatus comprises a first body cushion and a second body cushion, where the first body cushion has a magnet that is embedded thereto so that the magnet can be removably attachable to any metal surface of the sewing machine. An elastic netting is attached to the first body cushion for retaining chalk, spools of thread, etc. thereto. A pen opening is provided on front of the first body cushion for retaining and securing a pen or writing instrument thereto. The second body cushion also has a magnet that is embedded thereto for being removably attachable to the magnet of the first body cushion. The second body cushion has a netting for retaining a plurality of sewing parts and retaining a plurality of pins thereto, where the second body cushion is filled with cotton material for preventing the pins from penetrating therethrough. In addition, a semi-rigid plate is attached to the back of the second body cushion for further preventing the pins from penetrating therethrough.

32 Claims, 3 Drawing Sheets

PIN PICKUP AND ARTICLE HOLDER APPARATUS

BACKGROUND OF THE INVENTION

1. Field of the Invention

The present invention relates generally to the field of pouches for retaining a plurality of articles therein. More particularly, the present invention relates to the field of sewing pouches for retaining a plurality of different sewing parts therein and adapted for being removably attachable to a portion of a sewing machine.

2. Description of the Prior Art

Specifically, pin cushion holders are well known in the art. One of disadvantages with prior art pin cushion holders is that they only retain pins thereto and they do not have a place for retaining loose sewing articles, such as chalk, spools of thread, buttons, beads, etc. In addition, the prior art pin cushion holder does not have means for being removably attachable to a convenient location on the sewing machine. Therefore, a lot of time is consumed by a seamstress or tailor for hunting down where the sewing components are located. Another type of prior art pin cushion holder is a magnet pin pickup holder. However, this prior art pin pickup holder is only used for picking up loose pins on the floor or table and it does not have a place for retaining the pins and loose sewing articles.

The following nine (9) prior art patents are found to be pertinent to the field of the present invention:

1. U.S. Pat. No. 31,302 issued to Sinclair et al. on Aug. 1, 1899 for "Pincushion" (hereafter the "Sinclair");
2. U.S. Pat. No. 633,181 issued to Bernard on Sep. 19, 1899 for "Pincushion" (hereafter the "Bernard");
3. U.S. Pat. No. 667,673 issued to Burkart on Feb. 12, 1901 for "Pin Holder" (hereafter the "Burkart");
4. U.S. Pat. No. 1,696,771 issued to Larson on Dec. 25, 1928 for "Pincushion For Sewing Machines" (hereafter the "Larson");
5. U.S. Pat. No. 2,002,766 issued to Carlston on May 28, 1935 for "Pincushion Advertising Device" (hereafter the "Carlston");
6. U.S. Pat. No. 2,452,400 issued to Stevens on Oct. 26, 1948 for "Hairpin Holder" (hereafter the "Stevens");
7. U.S. Pat. No. 2,455,506 issued to Leslie on Dec. 7, 1948 for "Pin Pickup And Holder" (hereafter the "Leslie");
8. U.S. Pat. No. 5,507,041 issued to Wright on Apr. 16, 1996 for "Needle Holding Apparatus And Method Of Use" (hereafter the "Wright"); and
9. Design U.S. Pat. No. 39,514 issued to Buehler on Sep. 8, 1908 for "Pincushion And Receptacle" (hereafter the "Buehler").

Sinclair discloses a pincushion. Sinclair is strictly used for retaining pins.

Bernard discloses a pincushion. Bernard is also strictly used for retaining pins. It comprises a removable pin holder which is removable from a base which retains the removable pin holder.

Burkart discloses a pin holder. It comprises a frame, a pincushion pivotally secured to one side of the frame, and a pair of arms which extend on the other side of the frame with hooks for securing to each other to hold the frame to a sewing machine.

Larson discloses a pincushion for sewing machines. Larson teaches the pouch that is attached to a sewing machine by straps.

Carlston discloses a pincushion advertising device.

Stevens discloses a hairpin holder. Stevens teaches a tubular magnet ring for retaining pins. The magnet is disposed along the inside wall of a cup as a liner. The cup can be attached to a user by a strap.

Leslie discloses a pin pickup and holder. Leslie teaches a magnet enclosed within a dome, where the magnet is used for picking up pins.

Wright discloses a needle holding apparatus and method of use.

Buehler discloses a pincushion and receptacle.

It is desirable to provide a pin pickup and article holder apparatus that is flexible enough to allow repositioning of the apparatus on the sewing machine after it has been used for picking up loose pins or removed from the sewing machine. It is also desirable to provide a pin pickup and article holder apparatus with capability of picking up loose pins as well as retaining loose sewing parts therein. It is further desirable to provide a pin pickup and article holder apparatus which can provide optimum access to all of the sewing parts in a much more efficient way than prior art pin cushion holders.

SUMMARY OF THE INVENTION

The present invention is a pin pickup and article holder apparatus for retaining loose pins as well as loose sewing articles, such as chalk, spools of thread, buttons, beads, etc. One of the unique features of the present invention pin pickup and article holder apparatus is that it can be removably attachable to any metal surface of a sewing machine.

The pin pickup and article holder apparatus comprises a first body cushion and a second body cushion. The first body cushion has a magnet which is embedded within an upper portion thereto so that the magnet can be removably attachable to any metal surface of the sewing machine for removably attaching the first body cushion to the sewing machine. An elastic netting is attached to the front lower portion of the first body cushion for retaining chalk, spools of thread, etc. thereto. A pen opening is provided on front of the first body cushion for retaining and securing a pen or writing instrument thereto.

The second body cushion also has a magnet which is embedded thereto and located at the lower portion for being removably attachable to the magnet of the first body cushion. The first body cushion has an upper portion for accommodating and securing a plurality of pins thereto, where the upper portion is filled with cotton material for preventing the pins from penetrating therethrough. In addition, the upper portion may have a semi-rigid plate which is attached to the back of the second body cushion for further preventing the pins from penetrating therethrough. In the second body cushion, the magnet which is embedded therein is used for picking up loose pins which may be dropped on the floor or table. There is further provided an elastic netting for retaining a plurality of different sewing parts.

It is an object of the present invention to provide a pin pickup and article holder apparatus that can be removably attachable to any metal surface of the sewing machine at a point of convenience to the operator, while at the same time so arranged as not to interfere with the moving parts of the sewing machine.

It is also an object of the present invention to provide a pin pickup and article holder apparatus that is simple in construction, inexpensive to manufacture, very convenient when in use, compact, ornamental in appearance, and very efficient and durable in use.

It is an additional object of the present invention to provide a pin pickup and article holder apparatus that has means for being removably attachable to any metal surface of the sewing machine in such a manner that it will be retained thereto.

It is a further object of the present invention to provide a pin pickup and article holder apparatus that retains loose pins as well as sewing articles, such as chalk, spools of thread, buttons, beads, etc.

It is still a further object of the present invention to provide a pin pickup and article holder apparatus that can pick up loose pins from the floor or table without requiring the user to pick up the pins by hand.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
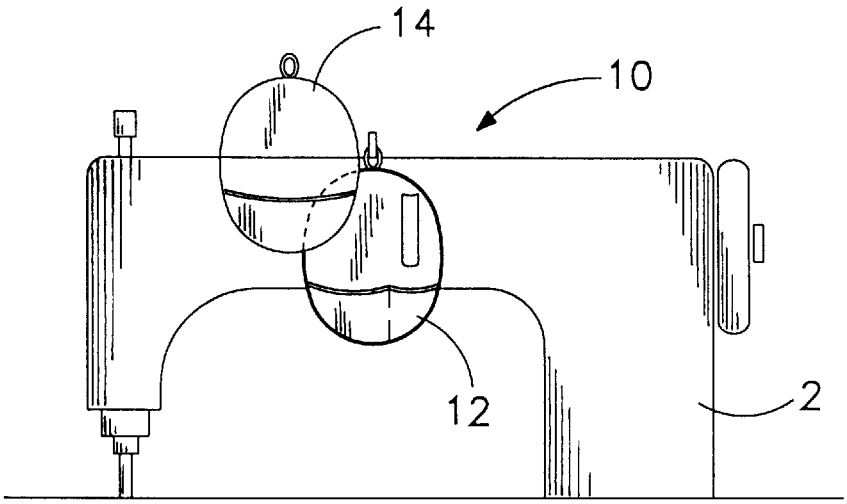
FIG. 1 is an elevational view of the present invention pin pickup and article holder apparatus removably attachable to any metal surface of a sewing machine.

Referring to FIG. 1, there is shown at 10 the present invention pin pickup and article holder apparatus for retaining loose pins as well as loose sewing articles, such as chalk, spools of thread, buttons, beads, etc. The pin pickup and article holder apparatus 10 is removably attachable to any metal surface of a sewing machine as shown. The pin pickup and article holder apparatus comprises a first attachable flexible body cushion 12 and a second attachable flexible body cushion 14.

Figure 2:
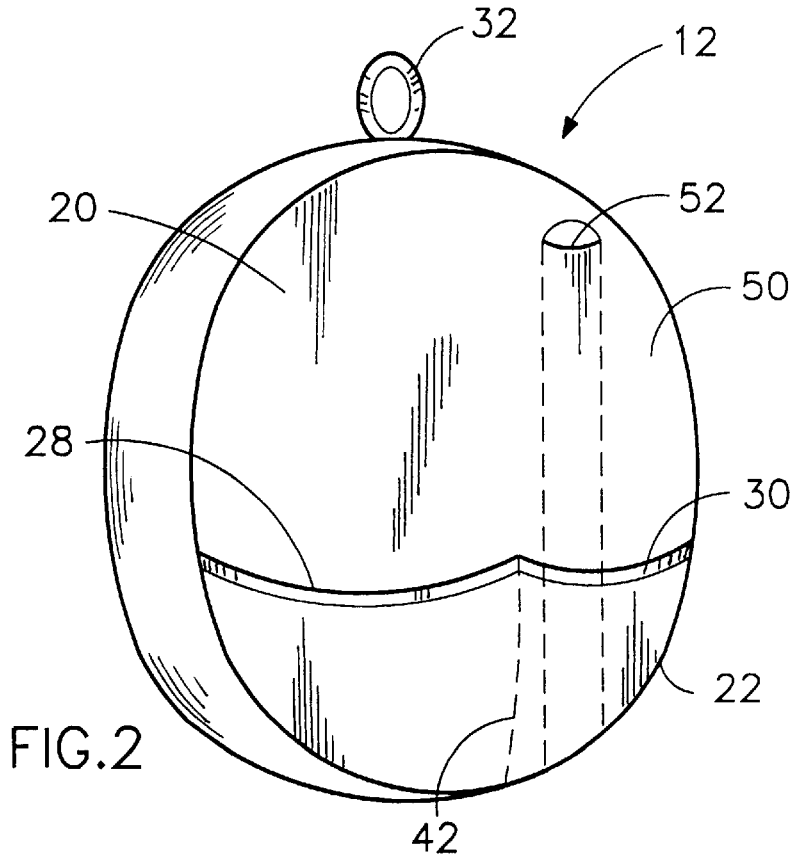
FIG. 2 is a perspective view of a first attachable body cushion in accordance with the present invention pin pickup and article holder apparatus.
Figure 3:
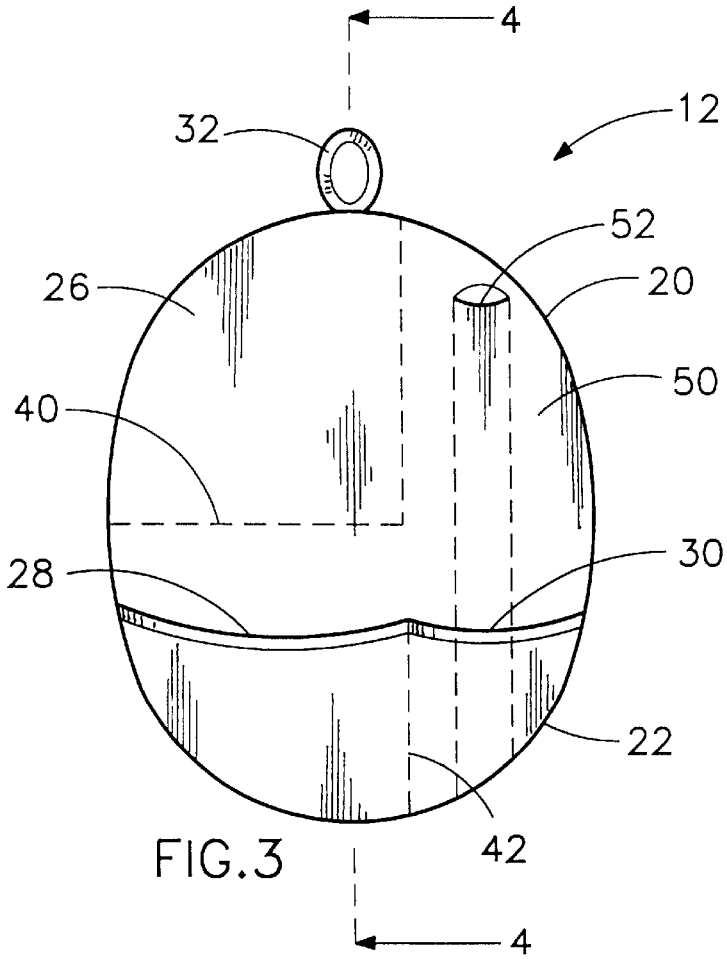
FIG. 3 is a front elevational view of the first attachable body cushion in accordance with the present invention pickup and article holder apparatus.
Figure 4:
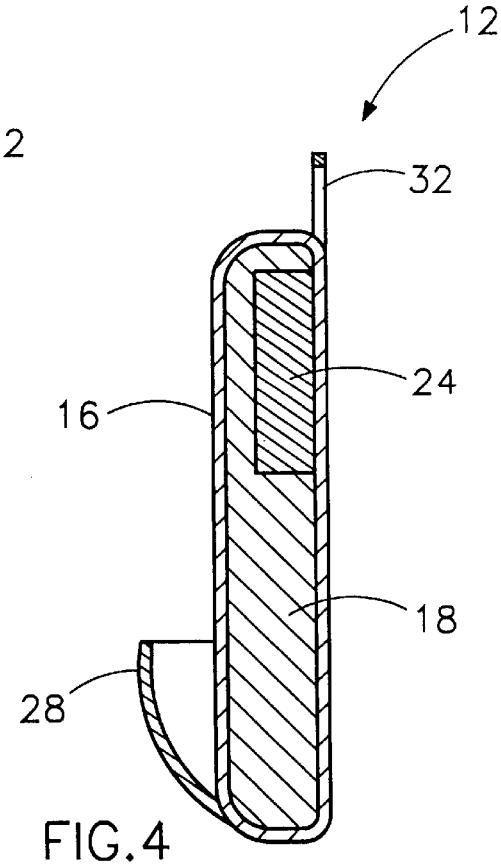
FIG. 4 is a cross-sectional view taken along line 4—4 of FIG. 3.

Referring to FIGS. 2, 3 and 4, there is shown at 12 the first attachable body cushion which is made from an outer cotton fabric 16 or polyester fabric and filled with polyester-fiber material 18 or other suitable material such as foam fiber material, wood shaved material and filling material. The first attachable body cushion 12 is generally an ellipse shape. The first body cushion 12 has an upper portion 20 and a lower portion 22. There is provided a conventional magnet 24 which is sized to fit and embedded within an upper left-hand region 26 of the upper portion 20 of the first body cushion 12 and held stationary by sewing a portion of the outer cotton fabric 16 together (see FIG. 3, shown in dashed lines 40). This magnet 24 is used for removably attaching the first attachable body cushion 12 to any metal surface of the sewing machine 2 or it can be used for picking up loose pins and held thereto. The upper portion 20 further has an upper right-hand region 50 for providing a place for pins to be inserted and secured thereto. There is also provided on the upper right-hand region 50 a pen aperture 52 for inserting and securing a pen or writing instrument to the first body cushion 12 of the apparatus 10. The pen aperture 52 is formed with stitched lines (shown as dashed lines) which extend downwardly from the aperture 52 to the bottom end of the lower portion 22.

The lower portion 22 is provided with an elastic stretchable netting 28 which is sized to cover the lower portion 22. The netting 28 is stitched to the perimeter of the first attachable body cushion 12, and thereby forms a large pocket 30 for holding a plurality of articles 4 therein, such as chalk, spools of thread, buttons, beads, etc. The large pocket 30 may be separated by a stitched line 42 to form two smaller pockets thereto.

If the sewing machine 2 does not have any metal surfaces, the first attachable body cushion 12 of the pin pickup and article holder apparatus 10 can be secured to the sewing machine 2 by an eyelet 32 which is attached to the top of the first body cushion 12.

Figure 5:
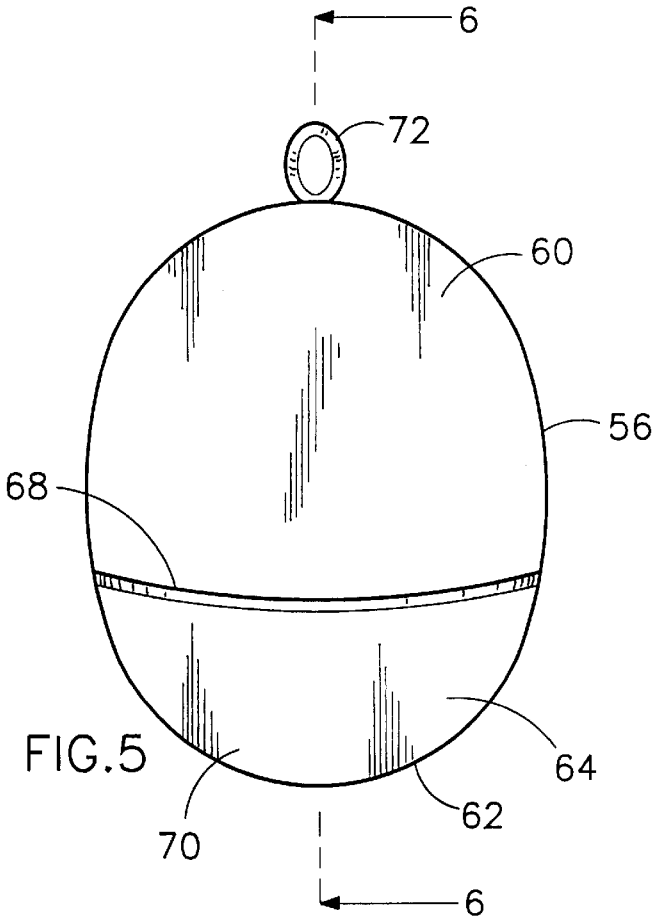
FIG. 5 is a perspective view of a second attachable body cushion in accordance with the present invention pin pickup and article holder apparatus.
Figure 6:
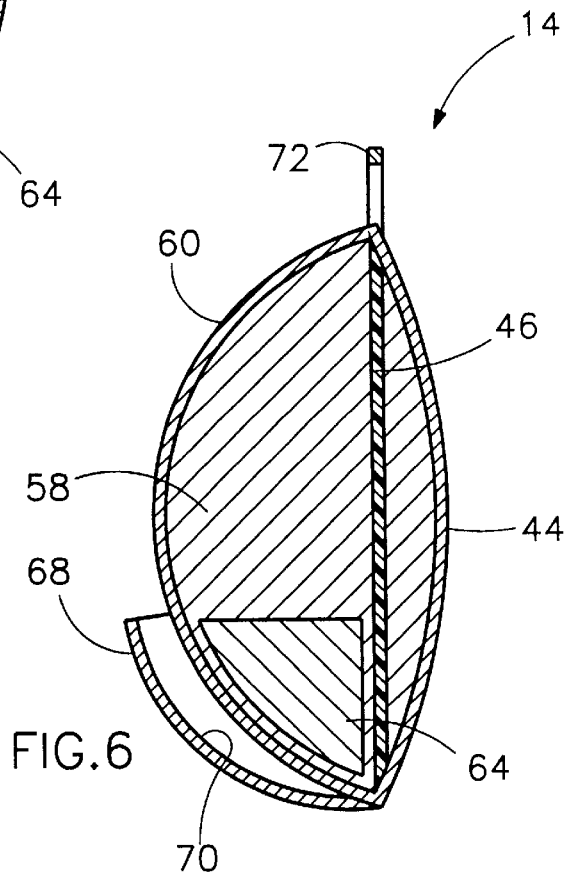
FIG. 6 is a cross-sectional view taken along line 6—6 of FIG. 5.

Referring to FIGS. 5 and 6, there is shown at 14 the second attachable body cushion of the apparatus 10 and which is made from an outer cotton fabric 56 or polyester fabric and filled with thick cotton material 58 or other suitable material such as foam fiber material, wood shaved material and filling material. The second body cushion 14 is generally an ellipse shape and has an upper portion 60 and a lower portion 62. There is provided a conventional magnet 64 which is sized to fit and be embedded within the lower portion 62 and held thereto by the thick cotton material 58. This magnet 64 is used for removably attaching the second body cushion 14 to the magnet 24 of the first body cushion 12 and it can also be used for picking up loose pins and be inserted and secured to the upper portion 60. The upper portion 20 is used for securing the pins thereto.

The lower portion 62 is provided with an elastic stretchable netting 68 which is sized to cover the lower portion 22. The netting 68 is stitched to the perimeter of the second body cushion 14, and thereby forms a large pocket 70 for holding a plurality of articles therein, such as chalk, spools of thread, buttons, beads, etc. The second body cushion 14 further has an eyelet 72 which is attached to the top of the second body cushion 14 for providing means for hanging to the first body cushion 12 or the sewing machine 2.

The second body cushion 14 further has a back portion 44 which is also filled with cotton material for preventing pins from penetrating through the upper portion 60 of the cushion 14. In addition, the back portion 44 may have a semi-rigid plate 46 for further preventing the pins from penetrating therethrough.

Referring to FIGS. 1 through 6, therefore, the pin pickup and article apparatus 10 is used by placing the first attachable body cushion 12 on the sewing machine 2 and held thereto by the magnet 24 on the metal surface and then the second attachable body cushion 14 may be attached to the magnet 24 by the magnet 64 within the second body cushion 14 as shown in FIG. 1.

It will be appreciated that the first and second attachable body cushions 12 and 14 are not limited to the stretchable netting as shown. It is emphasized that while the stretchable netting is the preferred, it is also within the spirit and scope of the present invention to utilize the first and second attachable body cushions without stretchable netting.

Defined in detail, the present invention is a pin pickup and article holder apparatus for being removably attachable to any metal surface of a sewing machine and retaining loose pins as well as loose sewing articles, the apparatus comprising: (a) a first attachable body cushion made from an outer cotton fabric material and filled with polyester-fiber material, the first body cushion having an upper portion and a lower portion; (b) a first magnet being removably attachable to the metal surface of the sewing machine and sized to fit and embedded within the upper portion of the first body cushion and held stationary by stitching a front layer and a back layer of the outer cotton fabric material together to secure the first magnet therein; (c) a first elastic stretchable netting sized to cover and stitched to a perimeter of the lower portion of the first body cushion to form a pocket for retaining the loose sewing articles thereto; (d) a second attachable body cushion made from an outer cotton fabric material and filled with thick cotton material, the second body cushion having an upper portion for securing pins thereto and a lower portion; (e) a second magnet for picking up loose pins and being removably attachable to the first magnet of the first body cushion, the second magnet sized to fit and embedded within the lower portion of the second body cushion; (f) a second elastic stretchable netting sized to cover and stitched to a perimeter of the lower portion of the second body cushion to form a pocket for retaining the loose sewing articles thereto; and (g) a semi-rigid plate attached to a rear of the second body cushion for preventing the pins from penetrating therethrough; (h) whereby the pin pickup and article holder apparatus is used for retaining the loose pins as well as the loose sewing articles such that the first magnet is removably attachable to the metal surface of the sewing machine and the second magnet is removably attachable to the first magnet.

Defined broadly, the present invention is a pin pickup and article holder apparatus for being removably attachable to any metal surface of a sewing machine and retaining loose pins as well as loose sewing articles, the apparatus comprising: (a) a first body cushion made from a fabric material and filled with a first flexible material, the first body cushion having an upper portion and a lower portion; (b) a first magnet for being removably attachable to the metal surface of the sewing machine and embedded within the upper portion of the first body cushion and held stationary by stitching a front layer and a hack layer of the fabric material together to secure the first magnet therein; (c) a first stretchable netting attached to a perimeter of the lower portion of the first body cushion to form a pocket for retaining the loose sewing articles thereto; (d) a second body cushion made from a fabric material and filled with a second flexible material, the second body cushion having an upper portion for securing pins thereto and a lower portion; (e) a second magnet for picking up loose pins and being removably attachable to the first magnet of the first body cushion, the second magnet embedded within the lower portion of the second body cushion; (f) a second stretchable netting attached to a perimeter of the lower portion of the second body cushion to form a pocket for retaining the loose sewing articles thereto; and (g) means for preventing the pins from penetrating through the second body cushion; (h) whereby the pin pickup and article holder apparatus is used for retaining the loose pins as well as the loose sewing articles such that the first magnet is removably attachable to the metal surface of the sewing machine and the second magnet is removably attachable to the first magnet.

Defined more broadly, the present invention is a pin pickup and article holder apparatus for being removably attachable to any metal surface of a sewing machine and retaining loose pins as well as loose sewing articles, the apparatus comprising: (a) a first body cushion; (b) a first magnet for being removably attachable to the metal surface of the sewing machine and embedded within the first body cushion; (c) a first netting attached to the first body cushion to form a pocket for retaining the loose sewing articles thereto; (d) a second body cushion; (e) a second magnet for picking up loose pins and being removably attachable to the first magnet of the first body cushion, the second magnet embedded within the second body cushion; and (f) a second netting attached to the second body cushion to form a pocket for retaining the loose sewing articles thereto; (g) whereby the pin pickup and article holder apparatus is used for retaining the loose pins as well as the loose sewing articles such that the first magnet is removably attachable to the metal surface of the sewing machine and the second magnet is removably attachable to the first magnet.

Further defined in detail, the present invention is a pin pickup and article holder apparatus for being removably attachable to any metal surface of a sewing machine and retaining loose pins as well as loose sewing articles, the apparatus comprising: (a) a first attachable body cushion made from an outer cotton fabric material and filled with polyester-fiber material, the body cushion having an upper portion and a lower portion; (b) a first magnet for being removably attachable to the metal surface of the sewing machine and sized to fit and embedded within the upper portion and held stationary by stitching a front layer and a back layer of the outer cotton fabric material together to secure the magnet therein; and (c) a first elastic stretchable netting sized to cover and stitched to a perimeter of the lower portion to form a pocket for retaining the loose sewing articles thereto; (d) whereby the pin pickup and article holder apparatus is used for retaining the loose pins as well as the loose sewing articles such that the magnet is removably attachable to the metal surface of the sewing machine.

Further defined broadly, the present invention is a pin pickup and article holder apparatus for being removably attachable to any metal surface of a sewing machine and retaining loose pins as well as loose sewing articles, the apparatus comprising: (a) a first body cushion made from a fabric material and filled with a first flexible material; (b) a first magnet for being removably attachable to the metal surface of the sewing machine and embedded within the body cushion and held stationary thereto; and (c) a first stretchable netting attached to the first body cushion to form a pocket for retaining the loose sewing articles thereto; (d) whereby the pin pickup and article holder apparatus is used for retaining the loose pins as well as the loose sewing articles such that the magnet is removably attachable to the metal surface of the sewing machine.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A pin pickup and article holder apparatus for being removably attachable to any metal surface of a sewing machine and retaining loose pins as well as loose sewing articles, the apparatus comprising:

a. a first attachable body cushion made from an outer cotton fabric material and filled with polyester-fiber material, the first body cushion having an upper portion and a lower portion;

b. a first magnet for being removably attachable to said metal surface of said sewing machine and sized to fit and embedded within said upper portion of said first body cushion and held stationary by stitching a front layer and a back layer of said outer cotton fabric material together to secure the first magnet therein;

c. a first elastic stretchable netting sized to cover and stitched to a perimeter of said lower portion of said first body cushion to form, a pocket for retaining said loose sewing articles thereto;

d. a second attachable body cushion made from an outer cotton fabric material and filled with thick cotton material, the second body cushion having an upper portion for securing pins thereto and a lower portion;

e. a second magnet for picking up loose pins and being removably attachable to said first magnet of said first body cushion, the second magnet sized to fit and embedded within said lower portion of said second body cushion;

f. a second elastic stretchable netting sized to cover and stitched to a perimeter of said lower portion of said second body cushion to form a pocket for retaining said loose sewing articles thereto; and g. a semi-rigid plate attached to a rear of said second body cushion for preventing said pins from penetrating therethrough;

h. whereby said pin pickup and article holder apparatus is used for retaining said loose pins as well as said loose sewing articles such that said first magnet is removably attachable to said metal surface of said sewing machine and said second magnet is removably attachable to said first magnet.

2. The apparatus in accordance with claim 1, wherein each of said first and second body cushions further comprises an eyelet for hanging to said sewing machine.

3. The apparatus in accordance with claim 1, wherein said upper portion of said first body cushion further comprises a pen aperture for securing a pen or writing instrument thereto.

4. The apparatus in accordance with claim 1, wherein said upper portion of said first body cushion is used for securing said loose pins thereto.

5. The apparatus in accordance with claim 1, wherein each of said first and second body cushions is generally an ellipse shape.

6. A pin pickup and article holder apparatus for being removably attachable to any metal surface of a sewing machine and retaining loose pins as well as loose sewing articles, the apparatus comprising:

a. a first body cushion made from a fabric material and filled with a first flexible material, the first body cushion having an upper portion and a lower portion;

b. a first magnet for being removably attachable to said metal surface of said sewing machine and embedded within said upper portion of said first body cushion and held stationary by stitching a front layer and a back layer of said fabric material together to secure the first magnet therein;

c. a first stretchable netting attached to a perimeter of said lower portion of said first body cushion to form a pocket for retaining said loose sewing articles thereto;

d. a second body cushion made from a fabric material and filled with a second flexible material, the second body cushion having an upper portion for securing pins thereto and a lower portion;

e. a second magnet for picking up loose pins and being removably attachable to said first magnet of said first body cushion, the second magnet embedded within said lower portion of said second body cushion;

f. a second stretchable netting attached to a perimeter of said lower portion of said second body cushion to form a pocket for retaining said loose sewing articles thereto; and g. means for preventing said pins from penetrating through said second body cushion;

h. whereby said pin pickup and article holder apparatus is used for retaining said loose pins as well as said loose sewing articles such that said first magnet is removably attachable to said metal surface of said sewing machine and said second magnet is removably attachable to said first magnet.

7. The apparatus in accordance with claim 6, wherein said first and second body cushions each further comprises an eyelet for hanging to said sewing machine.

8. The apparatus in accordance with claim 6, wherein said upper portion of said first body cushion further comprise a pen aperture for securing a pen or writing instrument thereto.

9. The apparatus in accordance with claim 6, wherein said upper portion of said first body cushion is used for securing said loose pins thereto.

10. The apparatus in accordance with claim 6, wherein said fabric material includes cotton material.

11. The apparatus in accordance with claim 6, wherein said first flexible material is polyester-fiber material.

12. The apparatus in accordance with claim 6, wherein said second flexible material includes thick cotton material.

13. The apparatus in accordance with claim 6, wherein said preventing means includes a plate attached to a rear of said second body cushion.

14. A pin pickup and article holder apparatus for being removably attachable to any metal surface of a sewing machine and retaining loose pins as well as loose sewing articles, the apparatus comprising:

a. a first body cushion;

b. a first magnet for being removably attachable to said metal surface of said sewing machine and embedded within said first body cushion;

c. a first netting attached to said first body cushion to form a pocket for retaining said loose sewing articles thereto;

d. a second body cushion;

e. a second magnet for picking up loose pins and being removably attachable to said first magnet of said first body cushion, the second magnet embedded within said second body cushion; and f. a second netting attached to said second body cushion to form a pocket for retaining said loose sewing articles thereto;

g. whereby said pin pickup and article holder apparatus is used for retaining said loose pins as well as said loose sewing articles such that said first magnet is removably attachable to said metal surface of said sewing machine and said second magnet is removably attachable to said first magnet.

15. The apparatus in accordance with claim 14, wherein said first and second body cushions each further comprises an eyelet for hanging to said sewing machine.

16. The apparatus in accordance with claim 14, wherein said first body cushion further comprises a pen aperture for securing a pen or writing instrument thereto.

17. The apparatus in accordance with claim 14, wherein said first body cushion is made from a cotton fabric material and filled with polyester-fiber material.

18. The apparatus in accordance with claim 14, wherein said second body cushion is made from a cotton fabric material and filled with thick cotton material.

19. The apparatus in accordance with claim 14, further comprising a plate attached to a rear of said second body cushion for preventing said pins from penetrating therethrough.

20. A pin pickup and article holder apparatus for being removably attachable to any metal surface of a sewing machine and retaining loose pins as well as loose sewing articles, the apparatus comprising:

a. a first attachable body cushion made from an outer cotton fabric material and filled with polyester-fiber material, the body cushion having an upper portion and a lower portion;

b. a first magnet for being removably attachable to said metal surface of said sewing machine and sized to fit and embedded within said upper portion and held stationary by stitching a front layer and a back layer of said outer cotton fabric material together to secure the magnet therein; and c. a first elastic stretchable netting sized to cover and stitched to a perimeter of said lower portion to form a pocket for retaining said loose sewing articles thereto;

d. whereby said pin pickup and article holder apparatus is used for retaining said loose pins as well as said loose sewing articles such that said magnet is removably attachable to said metal surface of said sewing machine.

21. The apparatus in accordance with claim 20, further comprising:

a. a second attachable body cushion made from an outer cotton fabric material and filled with thick cotton material, the second body cushion having an upper portion for securing pins thereto and a lower portion;

b. a second magnet for picking up loose pins and being removably attachable to said first magnet of said first body cushion, the second magnet sized to fit and embedded within said lower portion of said second body cushion;

c. a second elastic stretchable netting sized to cover and stitched to a perimeter of said lower portion of said second body cushion to form a pocket for retaining said loose sewing articles thereto; and d. a semi-rigid plate attached to a rear of said second body cushion for preventing said pins from penetrating therethrough.

22. The apparatus in accordance with claim 21, wherein said body cushions each further comprises an eyelet for hanging to said sewing machine.

23. The apparatus in accordance with claim 20, wherein said upper portion of said body cushion further comprises a pen aperture for securing a pen or writing instrument thereto.

24. The apparatus in accordance with claim 20, wherein said upper portion of said body cushion is used for securing said loose pins thereto.

25. A pin pickup and article holder apparatus for being removably attachable to any metal surface of a sewing machine and retaining loose pins as well as loose sewing articles, the apparatus comprising:

a. a first body cushion made from a fabric material and filled with a first flexible material;

b. a first magnet for being removably attachable to said metal surface of said sewing machine and embedded within said body cushion and held stationary thereto; and c. a first stretchable netting attached to said first body cushion to form a pocket for retaining said loose sewing articles thereto;

d. whereby said pin pickup and article holder apparatus is used for retaining said loose pins as well as said loose sewing articles such that said magnet is removably attachable to said metal surface of said sewing machine.

26. The apparatus in accordance with claim 25, further comprising:

a. a second body cushion made from a fabric material and filled with a second flexible material;

b. a second magnet for picking up loose pins and being removably attachable to said first magnet, the second magnet embedded within said second body cushion;

c. a second stretchable netting attached to said second body cushion to form a pocket for retaining said loose sewing articles thereto; and d. means for preventing said pins from penetrating through said second body cushion.

27. The apparatus in accordance with claim 26, wherein said first and second body cushions each further comprises an eyelet for hanging to said sewing machine.

28. The apparatus in accordance with claim 25, wherein said first body cushion further comprises a pen aperture for securing a pen or writing instrument thereto.

29. The apparatus in accordance with claim 26, wherein said fabric material includes cotton material.

30. The apparatus in accordance with claim 25, wherein said first flexible material is polyester-fiber material.

31. The apparatus in accordance with claim 26, wherein said second flexible material includes thick cotton material.

32. The apparatus in accordance with claim 26, wherein said preventing means includes a plate attached to a rear of said second body cushion.

* * * * *